US010232644B2

(12) United States Patent
Wada et al.

(10) Patent No.: US 10,232,644 B2
(45) Date of Patent: Mar. 19, 2019

(54) PRINTING APPARATUS AND PLATEN

(71) Applicant: CANON KABUSHIKI KAISHA, Tokyo (JP)

(72) Inventors: Itaru Wada, Tokyo (JP); Arihito Miyakoshi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/266,869

(22) Filed: Sep. 15, 2016

(65) Prior Publication Data

US 2017/0087884 A1 Mar. 30, 2017

(30) Foreign Application Priority Data

Sep. 24, 2015 (JP) ..... 2015-187328

(51) Int. Cl.
*B41J 11/00* (2006.01)
*B41J 2/17* (2006.01)

(52) U.S. Cl.
CPC ..... *B41J 11/0085* (2013.01); *B41J 2/1714* (2013.01); *B41J 11/0065* (2013.01)

(58) Field of Classification Search
CPC ..... B41J 11/0085; B41J 11/0065
See application file for complete search history.

(56) References Cited

U.S. PATENT DOCUMENTS 6,575,554 B2 6/2003 Yoshinaga
6,886,908 B2 5/2005 Takahashi et al.
8,469,486 B2 6/2013 Sutton et al.
9,150,022 B2 10/2015 Miyakoshi et al.
9,469,114 B2 10/2016 Miyakoshi et al.
2002/0041303 A1* 4/2002 Yoshinaga ..... B41J 2/1721 347/22
2004/0027412 A1* 2/2004 Takahashi ..... B41J 11/06 347/34
2010/0214343 A1* 8/2010 Yamaguchi ..... B41J 11/0025 347/16
2011/0221843 A1* 9/2011 Ozaki ..... B41J 11/0065 347/104
2013/0208049 A1* 8/2013 Yamamoto ..... B41J 11/0085 347/37
2016/0347092 A1* 12/2016 Kurata ..... B41J 11/0065
(Continued)

FOREIGN PATENT DOCUMENTS

JP 2002-187261 A 7/2002
JP 2004-001369 A 1/2004
JP 2007-331255 A 12/2007
(Continued)

OTHER PUBLICATIONS

Machine generated English translation of JP 2010017895A to Takanaka, "Inkjet Recorder"; translation retrieved from https://worldwide.espacenet.com/advancedSearch?DB=EPODOC&submitted=false&locale=en_EP&AB=&ST=advanced&compact=false on Mar. 30, 2018; 15 pp.*
(Continued)

*Primary Examiner* — Shelby L Fidler
(74) *Attorney, Agent, or Firm* — Venable LLP

(57) ABSTRACT

A recessed ink receiving portion is provided outside of a sheet supported by a supporting portion of a platen, for receiving ink ejected from a print head, and furthermore, a blowing-out hole is provided for supplying air toward an end of the sheet positioned above the ink receiving portion.

8 Claims, 14 Drawing Sheets

(56) References Cited

U.S. PATENT DOCUMENTS

2017/0259571 A1* 9/2017 Miyakoshi ..... B41J 2/165

FOREIGN PATENT DOCUMENTS

| | | | | |
|---|---|---|---|---|
| JP | 2010-017895 | A | | 1/2010 |
| JP | 2010017895 | A | * | 1/2010 |
| JP | 2015-027751 | A | | 2/2015 |

OTHER PUBLICATIONS

U.S. Appl. No. 15/160,532, filed May 20, 2016 Applicant: Tetsuji Kurata, et al.
Office Action dated Oct. 2, 2018, in Japanese Patent Application No. 2015-187328.

* cited by examiner

PRINTING APPARATUS AND PLATEN

BACKGROUND OF THE INVENTION

Field of the Invention

The present invention relates to an inkjet printing apparatus having a platen that can suck a sheet, and the platen.

Description of the Related Art

Japanese Patent Laid-Open No. 2007-331255 discloses an inkjet printing apparatus capable of forming an image without a margin at a sheet end, that is, performing so-called "marginless printing." The apparatus is provided with a suction platen that sucks a sheet to a sheet supporting portion by a negative pressure. Moreover, the suction platen includes an ink receiving portion that receives ejected ink or ink mist up to the outside of a sheet during marginless printing and an ink recovering hole, through which the ink received at the ink receiving portion is sucked and recovered by the negative pressure.

In the suction platen disclosed in Japanese Patent Laid-Open No. 2007-331255, the side end of the sheet is slightly floated from a sheet supporting portion in a case where the sheet is sucked and held, and therefore, a clearance may be created between the sheet and the sheet supporting portion. Since the clearance is created at a position nearer the side end of the sheet than the ink recovering hole, air flows from the side end of the sheet to the clearance. Due to the flow of air, a part of ink mist generated during the marginless printing is sucked into not the ink recovering hole but the clearance. At this time, the ink mist adheres onto the reverse of the sheet end, thereby smearing the end of the reverse of a printout.

SUMMARY OF THE INVENTION

An object of the present invention is to suppress the adhesion of ink mist onto the end of the reverse of a sheet supported by a platen.

According to an aspect of the present invention, a printing apparatus includes: a print head configured to eject ink; and a platen configured to support a sheet oppositely to the print head, the platen being featured by having a supporting portion configured to support the sheet; a recessed ink receiving portion configured to receive the ink ejected from the print head outside of the sheet supported by the supporting portion; a suction hole configured to suck air and the ink at the ink receiving portion; and a blowing-out hole configured to supply air toward an end of the sheet positioned above the ink receiving portion.

According to the present invention, air is intentionally supplied to the ink receiving portion, so as to suppress the adhesion of ink mist onto the end of the reverse of a sheet.

Further features of the present invention will become apparent from the following description of exemplary embodiments (with reference to the attached drawings).

DESCRIPTION OF THE EMBODIMENTS

A description will be given of embodiments of a printing apparatus according to the present invention. Explanation will be made below by way of a serial type inkjet printing apparatus, in which a print head capable of ejecting ink is reciprocated in a direction crossing a sheet conveyance direction so as to print an image on a sheet that is intermittently conveyed in a predetermined direction. The present invention is applicable to not only the serial type printing apparatus but also a line printing apparatus for sequentially performing printing by the use of an elongated print head. Moreover, the printing apparatus is applicable to a printing apparatus having a single function as well as a printer having multiple functions such as a copying function and a facsimile function.

First Embodiment

Figure 1:
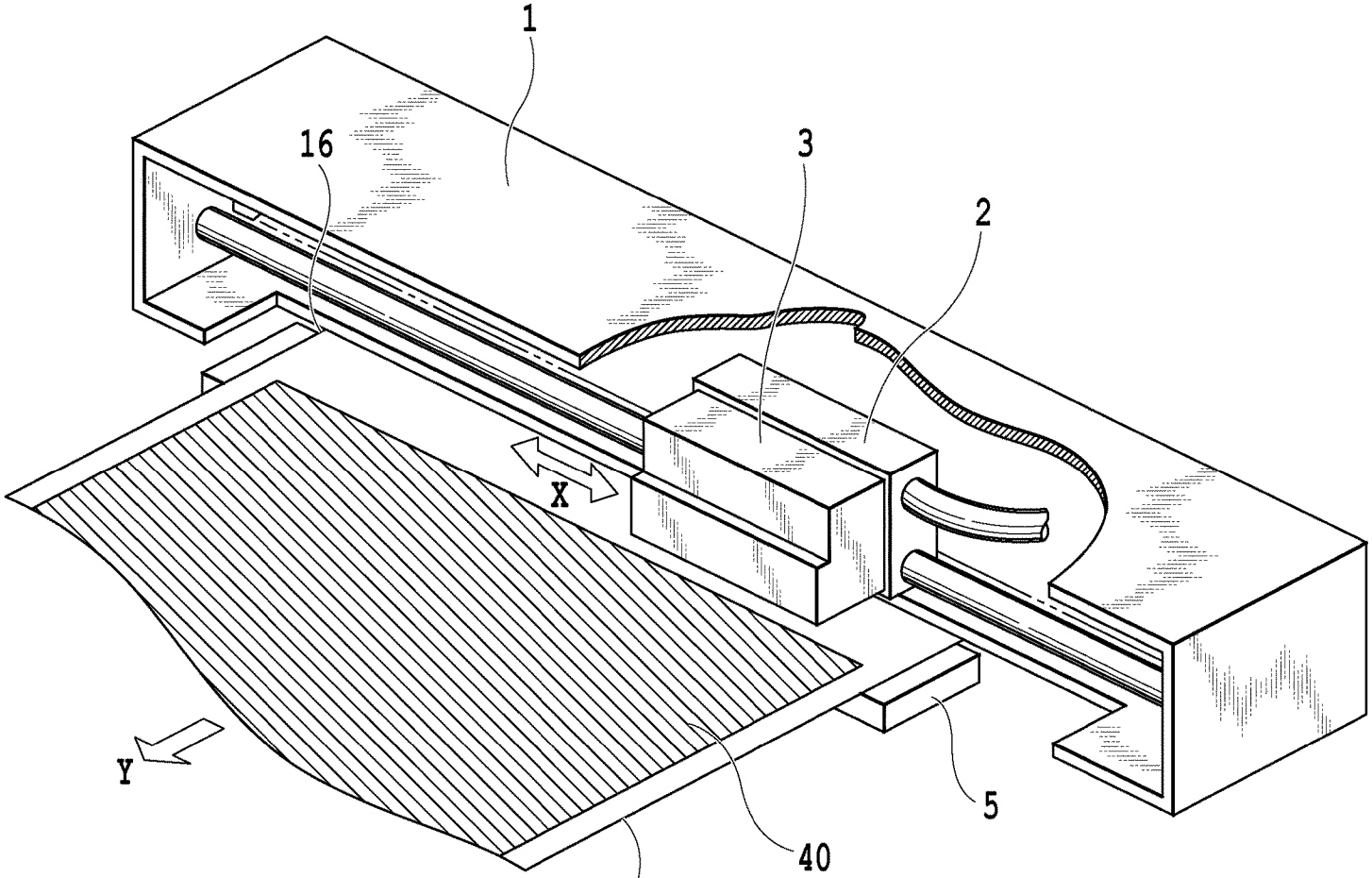
FIG. 1 is a perspective view showing an inkjet printing apparatus in an embodiment of the present invention.
Figure 2:
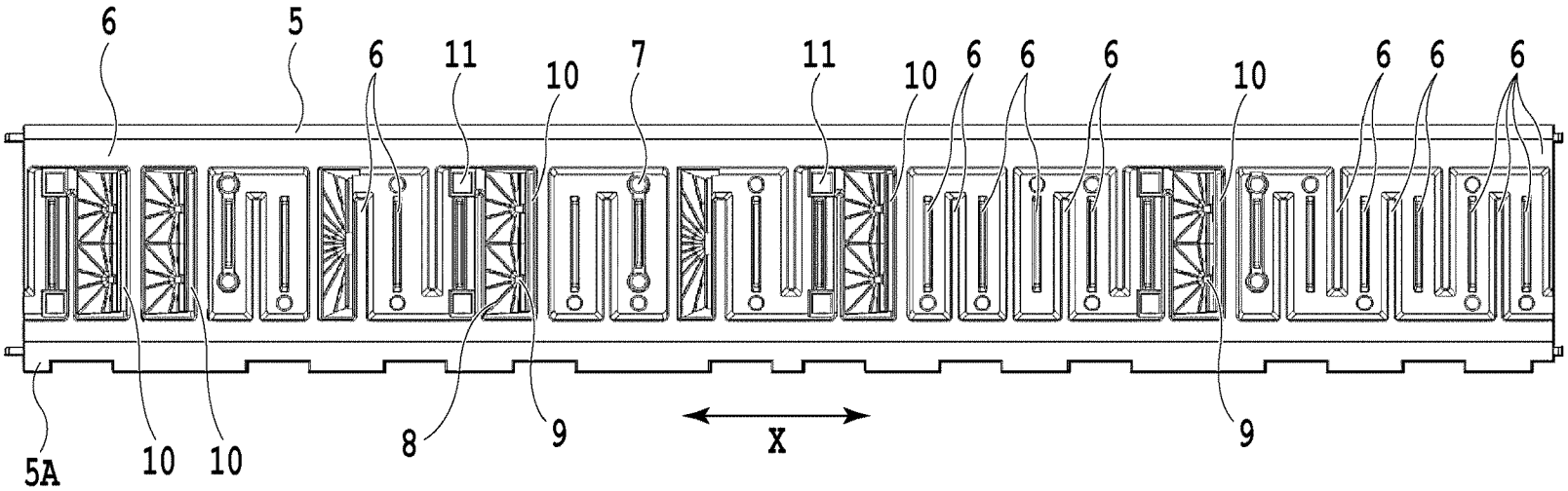
FIG. 2 is a plan view showing a platen in a first embodiment.

FIG. 1 is a perspective view schematically showing the inside structure of a main body unit of an inkjet printing apparatus in an embodiment; and FIG. 2 is a plan view showing a platen 5 shown in FIG. 1. In a printing apparatus 1, a print head 3 capable of ejecting ink ejects droplet-like ink (i.e., an ink droplet) onto a sheet 4 while being reciprocated in a main scanning direction (i.e., an X direction) together with a carriage 2, so as to achieve printing. Moreover, a sheet conveyance mechanism intermittently conveys the sheet 4 in a direction crossing the X direction (here a Y direction perpendicular to the X direction) in synchronism with the movement of the print head 3 in the X direction. The movement of the print head 3 in the X direction (also referred to as main scanning) and the intermittent conveyance of the sheet 4 are repeated, thus forming an image on the sheet 4. The printing apparatus 1 is provided with the platen 5 for supporting the sheet 4 conveyed by the sheet conveyance mechanism at the reverse thereof.

FIG. 2 is a plan view showing the platen 5. The platen 5 extends in the X direction (i.e., a sheet width direction) perpendicular to the sheet conveyance direction (i.e., the Y direction), and is formed into a hollow structure defined by a planar portion 5A (see FIG. 5) and a base portion 5B (see FIG. 5) disposed at the reverse of the planar portion 5A. A plurality of supporting portions 6 that support a surface (i.e., a reverse) opposite to an obverse (i.e., a surface to be printed) of the sheet 4 are arranged at a plurality of positions of the planar portion 5A of the platen 5 in the X direction. Consequently, various kinds of sheets 4 having different lengths in the X direction (i.e., widths) can be supported by the supporting portion 6 arranged at a position corresponding to the sheet width. Each of the plurality of supporting portions 6 has a supporting surface 6*a* (see FIG. 3) for supporting the reverse of the sheet 4 and a recess portion 6*b* surrounded by the supporting surface 6*a*. The supporting surfaces 6*a* have the same height. Moreover, a plurality of suction ports 7, each of which communicates with a negative pressure generator serving as an air suction source, are formed at the recess portion 6*b* surrounded by the supporting surface 6*a*. Air is sucked through the suction ports 7, so that the sheet 4 conveyed onto the platen 5 can be sucked to and supported at the supporting surface 6*a* in a flat state. Here, all of the suction ports 7 communicate with one and the same negative pressure generator. Incidentally, the negative pressure generator may include a fan housed inside of a duct communicating with the inside space of the platen 5.

In the case of the marginless printing in which an image is printed over the entire sheet 4 without any margins at the ends of the sheet 4, ink is ejected up to the outside of the sheet 4. In view of this, a plurality of recessed ink receiving portions 8 for receiving ink discarded outside of the sheet 4 are formed at the platen 5. The ink receiving portions 8 are formed at a plurality of positions in the X direction in a manner corresponding to the positions of side ends 4*a* of various kinds of sheets 4 in order to achieve the marginless printing on the sheets 4 having different widths.

The ink discarded outside of the sheet 4 contains not only a main droplet that has a predetermined size and is landed on the ink receiving portion 8 but also ink mist that is not landed on the ink receiving portion 8 but floats in the air in an atomized state. In view of this, ink recovering holes (i.e., suction holes) 9, each of which communicates with the negative pressure generator, are formed at the bottom of the ink receiving portion 8 such that the ink and ink mist discarded at the ink receiving portion 8 are sucked and recovered through the ink recovering holes 9 by a negative pressure.

Figure 3:
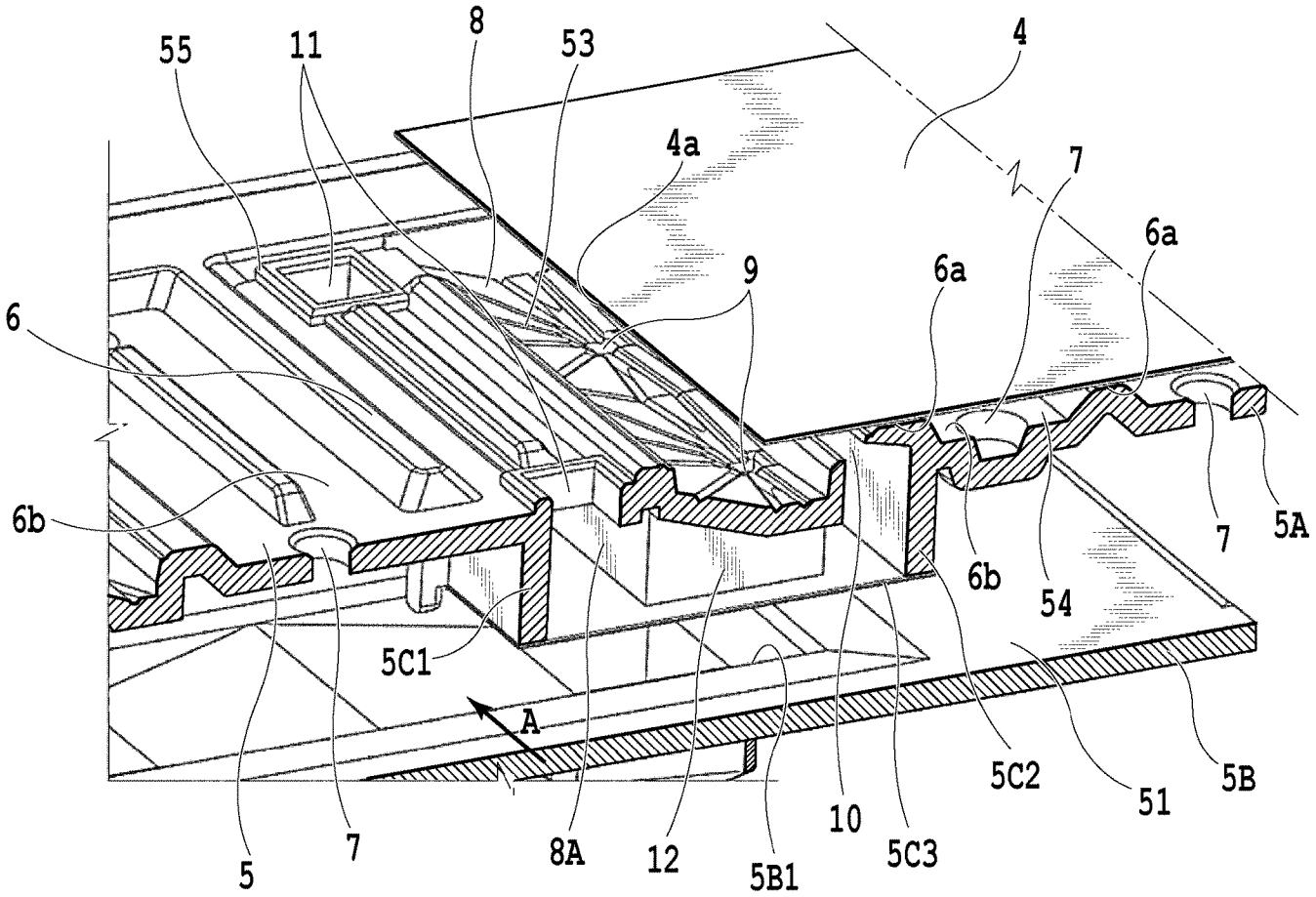
FIG. 3 is a cross-sectional perspective view showing, partly cut, the inkjet printing apparatus shown in FIG. 1.
Figure 4:
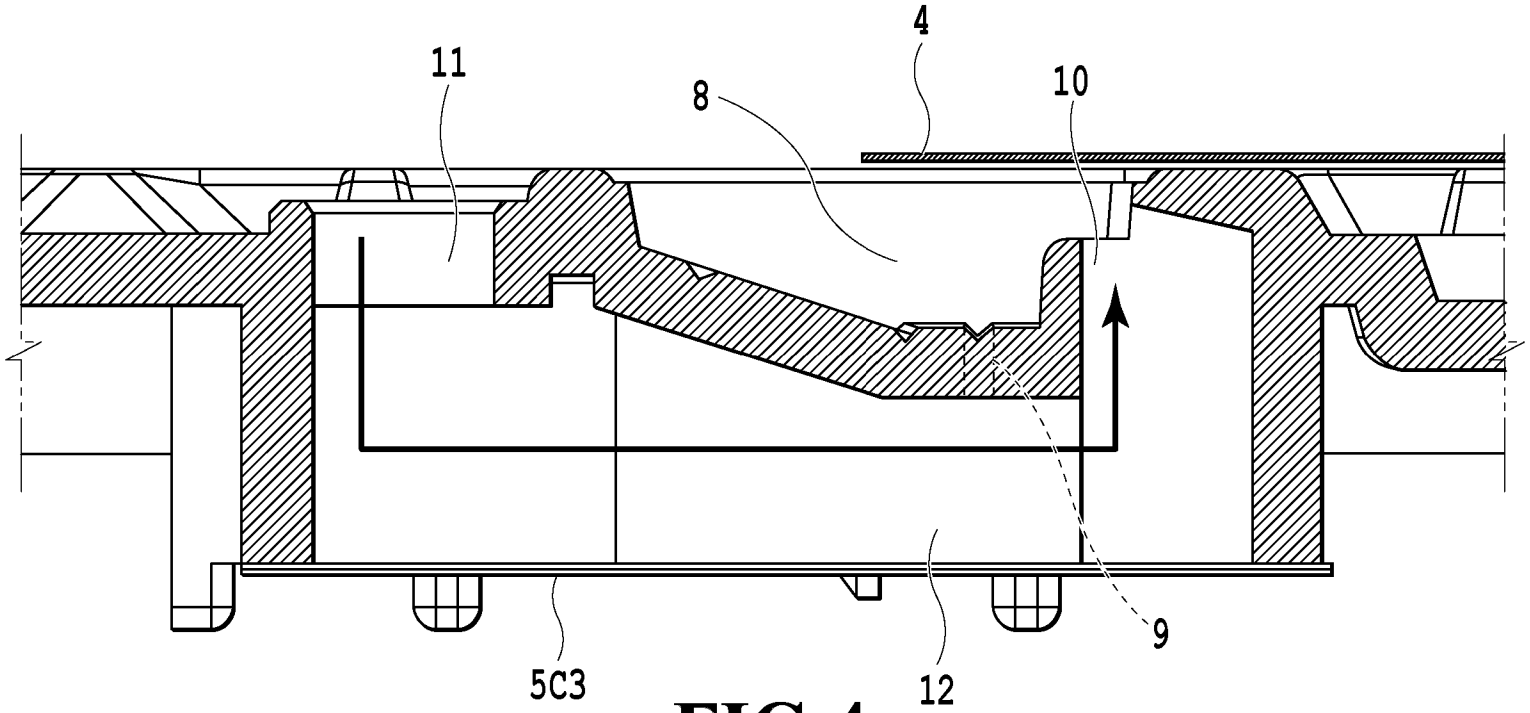
FIG. 4 is a side view showing the platen shown in FIG. 3, as viewed in a direction A.

FIG. 3 is a view showing the inside structure of the platen 5 around the side end 4*a* of the sheet 4 conveyed onto the platen 5, and more specifically, is a cross-sectional perspective view showing, partly cut, the printing apparatus shown in FIG. 1. FIG. 4 is a cross-sectional side view, as viewed in a direction indicated by an arrow A in FIG. 3. Inside of the platen 5 forming the hollow structure are formed a negative pressure area 51 serving as a space communicating with the air suction holes 7 and air introducing paths (i.e., channels) 12, each of which communicates with the ink recovering holes 9. The negative pressure area 51 is defined between the planar portion 5A and the base portion 5B that is formed into a U shape in cross section and is formed on the back side of the planar portion 5A. The base portion 5B has an opening 5B1. The opening 5B1 communicates with a duct for the negative pressure generator disposed at the outer surface (i.e., the lower surface in the drawing) of the base portion 5B. A fan serving as the negative pressure generator is disposed inside of the duct. In a case where the fan is driven to generate a negative pressure inside of the duct, a suction/holding area 54 communicating with the duct through the opening 5B is kept under the negative pressure. Consequently, the pressure in an area defined between the sheet 4 and the platen 5 becomes negative through the plurality of air suction holes 7 formed at the planar portion 5A so that the sheet 4 is sucked to and held at the supporting surface 6*a* of the platen 5. Hereinafter, the negative pressure area defined between the sheet 4 and the platen 5 is referred to as the suction/holding area 54.

As shown in FIG. 3, the ink receiving portion 8 is positioned under the side end 4*a* of the sheet 4 supported at the supporting surface 6*a*, and furthermore, a part thereof is positioned outside of the side end 4*a* of the sheet 4 in the X direction, thus forming an inclined surface 53 that is inclined from the outside to the inside. During the marginless printing, the ink discarded outside of the side end 4*a* of the sheet 4 is landed at the inclined surface 53 of the ink receiving portion 8, and then, flows into the ink recovering hole 9 along the inclined surface 53. Thereafter, the ink is recovered at an ink recovering unit disposed at the duct of the negative pressure generator through the opening 5B1. In addition, the ink recovering hole 9 also sucks and recovers the ink mist generated during the marginless printing.

A cylindrical discharging portion 8A whose bottom is opened projects from the reverse (i.e., the lower surface in the drawing) of the ink receiving portion 8. A pair of side walls 5C1 and 5C2 projecting from the planar portion 5A toward the back side is formed at positions separate from the outside surface of the discharging portion 8A. Moreover, a bottom plate 5C3 in close contact with the respective lower ends of the side walls 5C1 and 5C2 and the end of the discharging portion 8A is fixed to the planar portion 5A. A space defined by the bottom plate 5C3, the side walls 5C1 and 5C2, the discharging portion 8A, and the base portion 5B forms the air introducing path 12 passing under the ink receiving portion 8. The air introducing path 12 communicates with two air introducing holes 11 formed at the planar portion 5A and a slit-like air blowing-out hole 10 formed at the planar portion 5A. In this manner, air introduced through the air introducing holes 11 is guided to the air blowing-out hole 10. As shown in FIG. 3, the air introducing holes 11 are arranged in such a manner as to be positioned outside of the side end 4*a* of the sheet 4 in the X direction with the sheet supported at the supporting portion 6. The air blowing-out hole 10 is located above the ink recovering holes 9, and furthermore, is formed at a position in the proximity of the ink recovering holes 9 in the X direction.

Additionally, discharging ports are formed at positions opposite to the ink recovering holes 9 at the bottom plate 5C3. Therefore, the ink recovering holes 9 communicate with the negative pressure area 51 via the discharging portion 8A and the discharging ports formed at the bottom plate 5C3 so that the ink and ink mist flowing into the ink recovering holes 9 pass through the discharging portion 8A, to be thus guided to the duct of the negative pressure generator through the discharging ports. The ink recovering unit is disposed at the duct, and thus, the ink and ink mist flowing into the duct are recovered at the ink recovering unit. Incidentally, the discharging portion 8A defined between the air introducing holes 11 and the bottom plate 5C3 is separated from the air introducing path 12, and therefore, the ink and ink mist flowing into the discharging portion 8A cannot intrude into the air introducing path 12. Moreover, the negative pressure area 51 formed at the reverse of the platen 5 is separated from the air introducing path 12 with the sheet supported at the supporting surface 6*a*, as shown in FIG. 3.

The sheet conveyed onto the platen 5 is sucked to and supported at the supporting surface 6*a* of the supporting portion 6 under the negative pressure generated in the negative pressure area 51 defined between the sheet 4 and the platen 5. At this time, the side end 4*a* of the sheet 4 may be slightly warped, thereby defining a clearance between the side end 4*a* of the sheet 4 and the platen 5. In the conventional suction platen, air flows from the side end 4*a* of the sheet 4 under the negative pressure for sucking the sheet in such a manner as to pass a clearance. Along with this flow of air, a part of the ink mist generated during the marginless printing intrudes into the clearance without reaching the ink recovering holes 9. As a consequence, the ink mist adheres at the position opposite to the reverse of the sheet 4, more particularly, the end of the supporting portion 6 of the platen 5, thereby smearing the end of the reverse of the sheet 4.

In contrast, in the present embodiment, the blowing-out hole 10 is formed inside of the ink recovering holes 9 in the X direction, and furthermore, the air introducing holes 11 are formed outside of the ink recovering holes 9 in the X direction. Moreover, the air introducing path 12 separate from the negative pressure area 51 is formed at the reverse of the platen 5 in order to allow the air introducing holes 11 and the blowing-out hole 10 to communicate with each other. In a case where the side end 4*a* of the sheet 4 is slightly warped during printing so that a slight clearance is generated between the side end 4*a* of the sheet 4 and the platen 5, the air flows toward the clearance by the suction force generated in the suction/holding area 54. Since the blowing-out hole 10 is adjacent to the clearance, the air supplied from the blowing-out hole 10 flows toward the clearance. Specifically, the air taken in through the air introducing hole 11 is passively blown out of the blowing-out hole 10, and then, flows into the clearance, as shown in FIG. 4. Since the air introducing holes 11 are formed at the positions apart from the side end 4*a* of the sheet 4, the ink mist is contained in a very small amount into the air taken into the air introducing holes 11 and the air blown out of the blowing-out hole 10. As a consequence, even if the air supplied through the blowing-out hole 10 flows along the reverse of the sheet, the sheet is hardly smeared. In a case where the air is supplied to the clearance through the blowing-out hole 10, this functions as an air shield, thus substantially shielding the flow of the air toward the clearance from the periphery of the side end 4*a* of the sheet 4. Therefore, almost all the ink mist generated in the periphery of the side end 4*a* of the sheet 4 is sucked into the ink recovering holes 9, and therefore, the flow of the ink mist into the clearance is suppressed. With this mechanism, it is possible to remarkably reduce the adhesion of the ink mist onto the end of the reverse of the sheet, thus achieving an excellent printout.

Next, a description will be given of a desirable mode of the air introducing hole 11, the blowing-out hole 10, and the ink recovering hole 9 so as to achieve the effective suppression of the adhesion of the ink mist onto the reverse of the sheet 4. As shown in FIG. 3, since the air introducing holes 11 are formed at the bottom of the recess formed at the planar portion 5A of the platen 5, each of the air introducing holes 11 is surrounded by a rib 55 that is higher by one step. This is because the ink droplet possibly flows into the air introducing path 12 through the air introducing hole 11 without the rib 55 since the ink droplet may adhere to the bottom of the recess of the platen 5. In a case where the ink flows in through the air introducing hole 11, the ink mist is contained in a large amount in the air inside of the air introducing path 12. And thus, the air flowing from the blowing-out hole 10 is polluted, thereby raising the possibility of a smear on the reverse of the sheet.

It is desirable that the opening length of the blowing-out hole 10 formed into a slit should be set enough to cover the array region of ejection ports (i.e., an ejection port array) in the print head 3 in the sheet conveyance direction (i.e., the Y direction). In a case where a part of the blowing-out hole 10 does not cover the array region of ejection ports, the air cannot be blown out around the part. In this case, the flow of the air cannot be weakened, unlike the present embodiment, thereby raising the possibility of the smear on the reverse of the sheet due to the adhesion of the ink mist. Alternatively, the opening width of the blowing-out hole 10 may be varied in the direction perpendicular to the sheet conveyance direction (i.e., the X direction). In particular, the opening width of the blowing-out hole 10 may be increased downstream of the platen 5 at which the sheet is liable to be warped. In this manner, the air can be supplied in a large amount into the clearance defined between the side end 4*a* of the sheet 4 and the platen 5 through the blowing-out hole 10, thus properly suppressing the adhesion of the ink mist onto the reverse of the sheet 4.

As shown in FIG. 3, it is desirable that the plurality of ink recovering holes 9 formed at the ink receiving portion 8 should be formed at a plurality of portions in the sheet conveyance direction. This is because in a case where, for example, only one ink recovering hole 9 is formed, the ink mist cannot be satisfactorily sucked or recovered around a portion apart from the ink recovering hole 9, thereby raising the possibility of the adhesion of the remaining ink mist onto the reverse of the sheet 4.

It is desirable that the opening area of each of the blowing-out hole 10 and the air introducing hole 11 should be sufficiently greater than the opening area of the ink recovering hole 9. Moreover, it is preferable that the opening area of the air introducing hole 11 should be satisfactorily greater than the opening area of the ink recovering hole 9 such that the air blown out of the blowing-out hole 10 can be satisfactorily supplied into the ink recovering hole 9. For example, in FIG. 3, the opening area of the ink recovering hole 9 is 4.5 $mm^2$, the opening area of the blowing-out hole 10 is 35 $mm^2$, and the opening area of the air introducing hole 11 is 36 $mm^2$.

Subsequently, explanation will be made on the function of suppression of the degradation of an image at the side end 4*a* of the sheet 4. Around the side end 4*a* of the sheet 4, the air flows toward the ink recovering holes 9 and the air flows toward the clearance defined between the supporting surface 6*a* of the platen 5 and the sheet 4. In the conventional platen, these flows of the air induce the shift of the landing position of the ink droplet ejected from the print head 3, thereby possibly degrading an image.

In contrast, the blowing-out hole 10, through which the air is supplied upward, is formed in the present embodiment, and therefore, the air blown out of the blowing-out hole 10 is supplied into the ink recovering holes 9 or the clearance defined between the sheet 4 and the platen 5. This weakens the flow of the air toward the ink recovering hole 9 from the periphery of the side end 4*a* of the sheet 4 and the flow of the air toward the clearance defined between the sheet 4 and the platen 5 from the periphery of the side end 4*a* of the sheet 4. In other words, the flow rate of the air in the periphery of the side end 4*a* of the sheet 4 is decreased, thus suppressing the shift of the landing position of the ink droplet that is caused by the flow of the air.

Next, explanation will be made on the function of the platen 5 for sucking and holding the sheet 4. As shown in FIG. 3, in the case of the use of the sheet 4 having such a size that the side end 4*a* covers a part of the ink receiving portion 8, the blowing-out hole 10 stays communicating with the atmosphere through the air introducing path 12 and the air introducing holes 11. Therefore, a pressure right under the side end 4*a* of the sheet 4 becomes smaller than that in the suction/holding area 54. However, since the side end 4*a* of the sheet 4 is close to the suction/holding area 54, the side end 4*a* of the sheet 4 above the ink receiving portion 8 is sucked and held by a sheet suction force at the suction/holding area 54. At this time, although the side end 4*a* of the sheet 4 may be slightly warped, the above-described mechanism suppresses the smear of the ink on the reverse of the side end 4*a* of the sheet 4.

Figure 5:
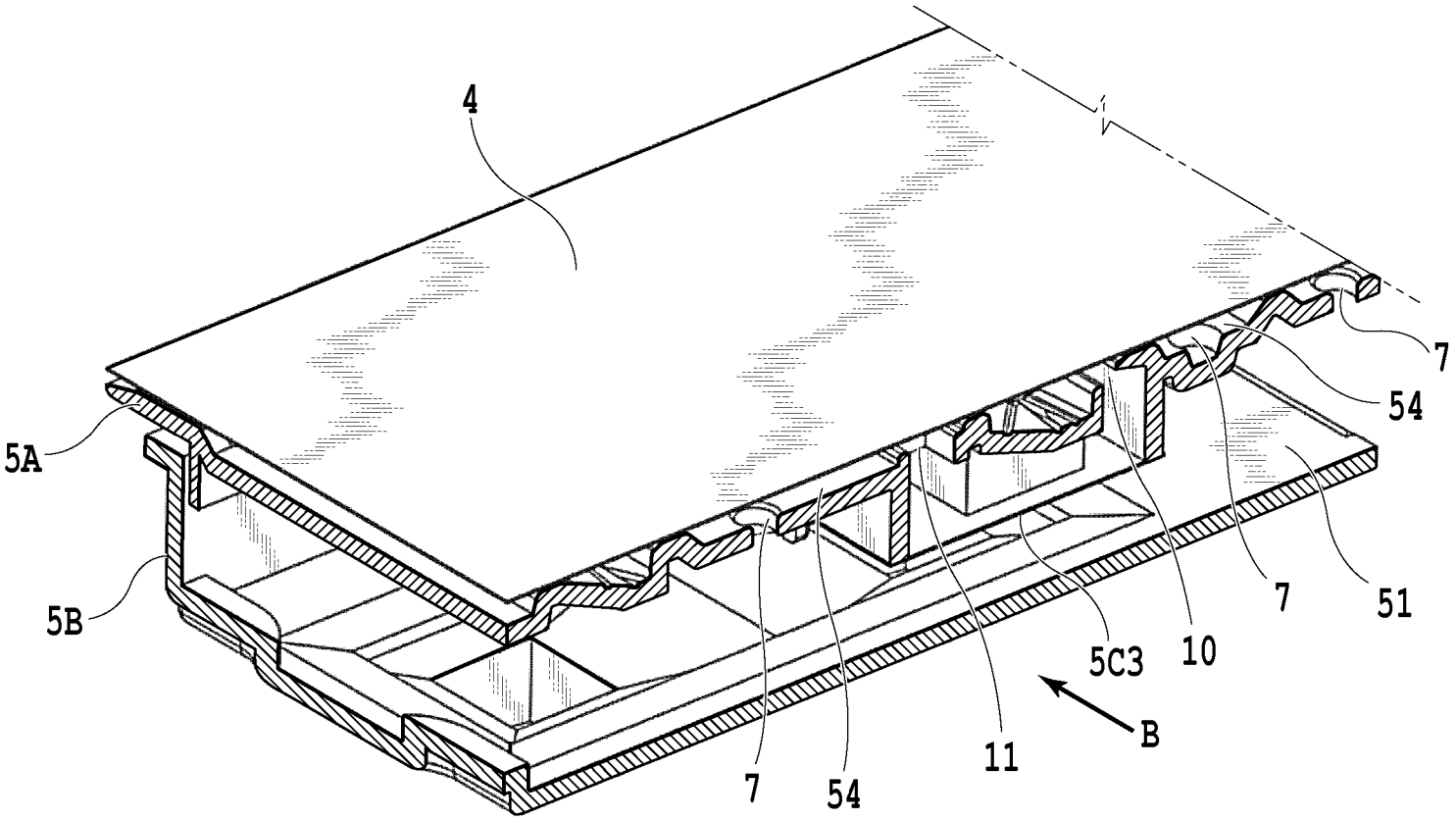
FIG. 5 is a cross-sectional perspective view showing, partly cut, the platen shown in FIG. 1.
Figure 6:
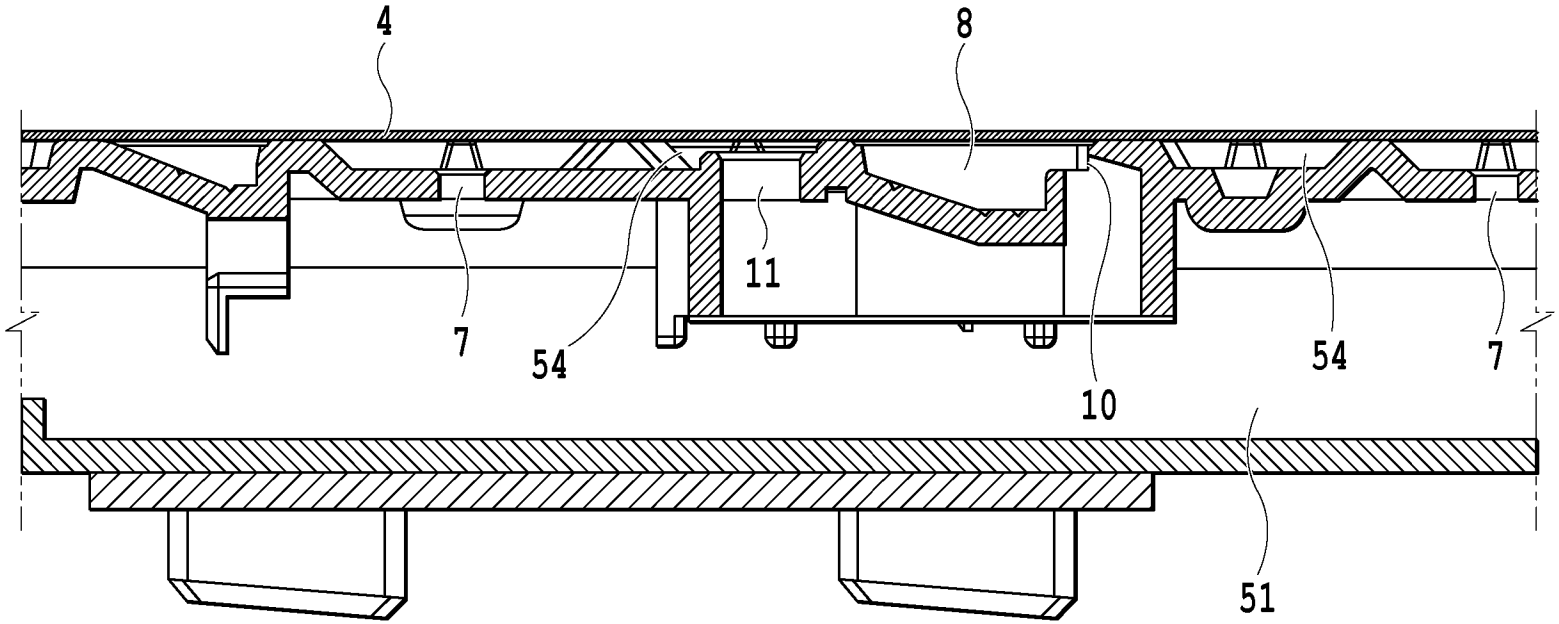
FIG. 6 is a side view showing the platen shown in FIG. 5, as viewed in a direction B.

In the meantime, in a case where the sheet 4 has a size enough to cover the entire ink receiving portion 8, as shown in FIG. 5 and FIG. 6 as viewed in a direction indicated by an arrow B in FIG. 5, the suction/holding area 54 is enlarged due to the sheet 4 per se, so that the ink receiving portion 8 in FIGS. 5 and 6 also serves as the suction/holding area 54. At this time, since the air introducing holes 11 are arranged at the recessed bottom of the platen 5, a pressure at the air introducing holes 11 becomes equal to that in the suction/holding area 54. Moreover, a pressure at the blowing-out hole 10 communicating with the air introducing holes 11 becomes equal to that in the suction/holding area 54 as well. Consequently, the sheet 4 positioned above the ink receiving portion 8 can be satisfactorily sucked and held.

In the above-described embodiment, the blowing-out hole 10 is formed for supplying the air upwardly toward the end of the reverse of the sheet positioned above the recessed ink receiving portion 8, and then, the air is intentionally supplied from the blowing-out hole 10. This functions as an air shield, thus suppressing the smear of the end of the reverse of the sheet with the ink mist. At this time, the function of the blowing-out hole 10 is automatically changed according to the width of the sheet. Specifically, in a case where the end of the sheet is located above the ink receiving portion 8, the blowing-out hole 10 fulfills the function of the air shield. In contrast, in a case where the recessed ink receiving portion 8 is fully covered with the sheet, the blowing-out hole 10 does not inhibit the negative pressure state of the ink receiving portion 8 for sucking and holding the sheet.

Second Embodiment

Figure 7:
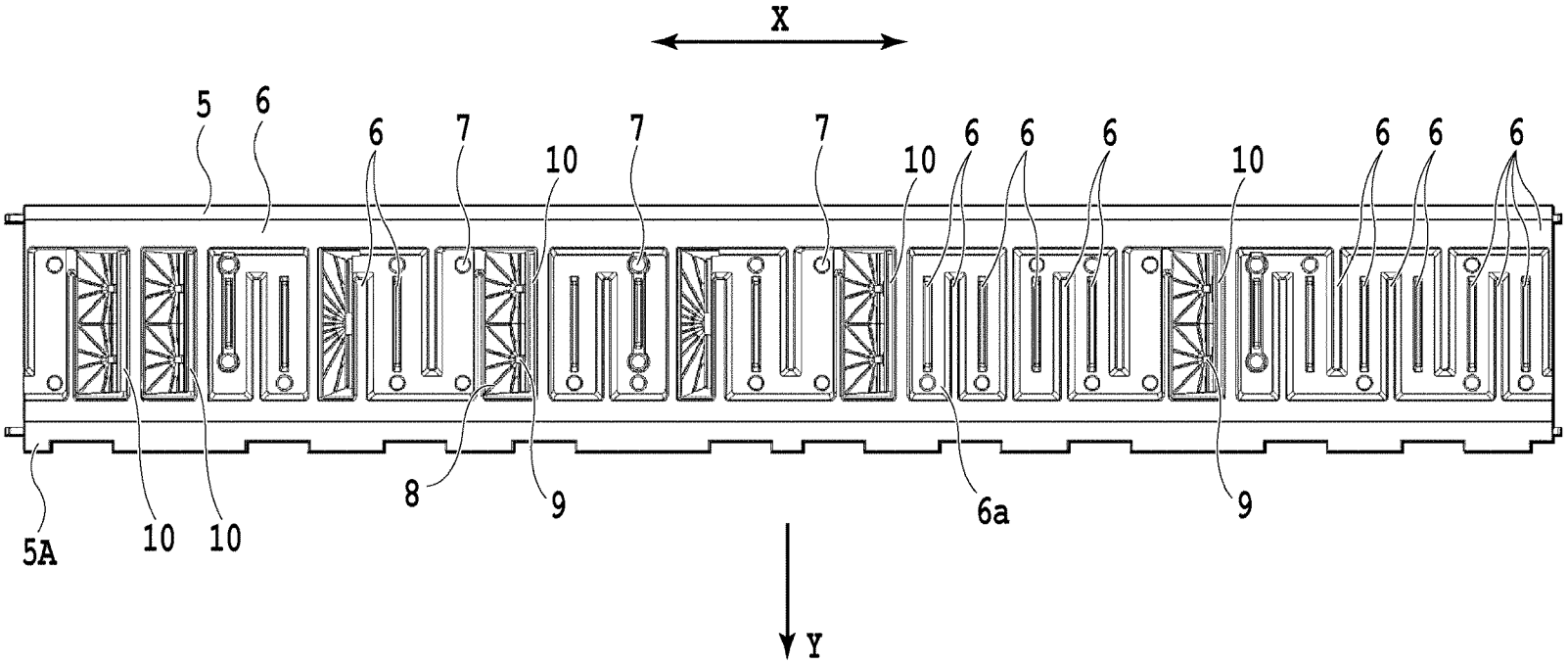
FIG. 7 is a plan view showing a platen in a second embodiment.
Figure 8A:
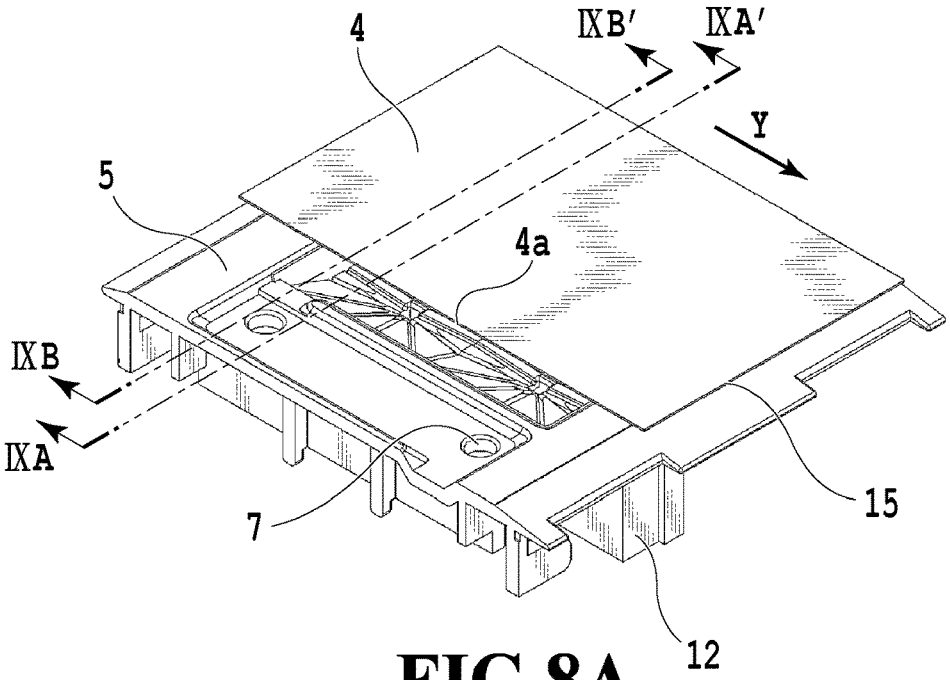
FIGS. 8A and 8B are perspective views showing the platen shown in FIG. 7, as partly viewed from slantwise above.
Figure 8B:
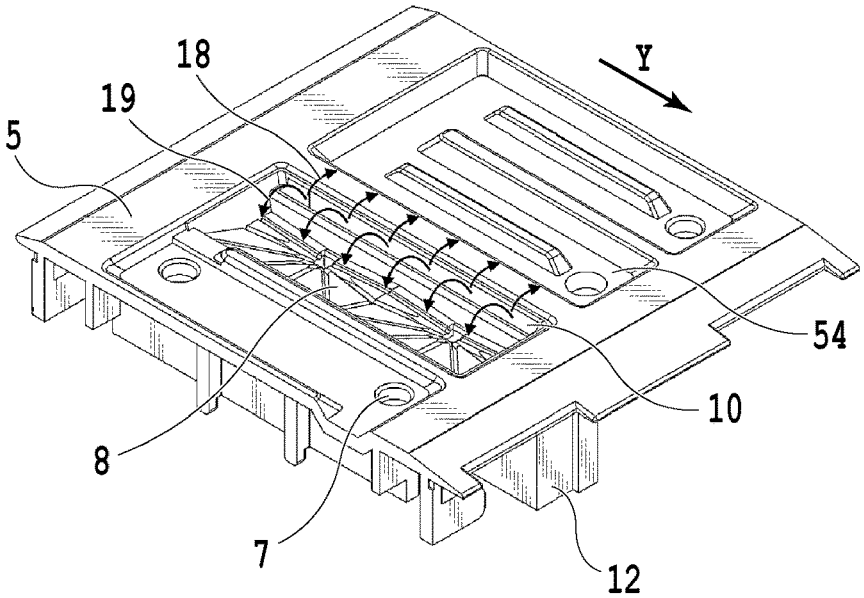
Figure 9A:
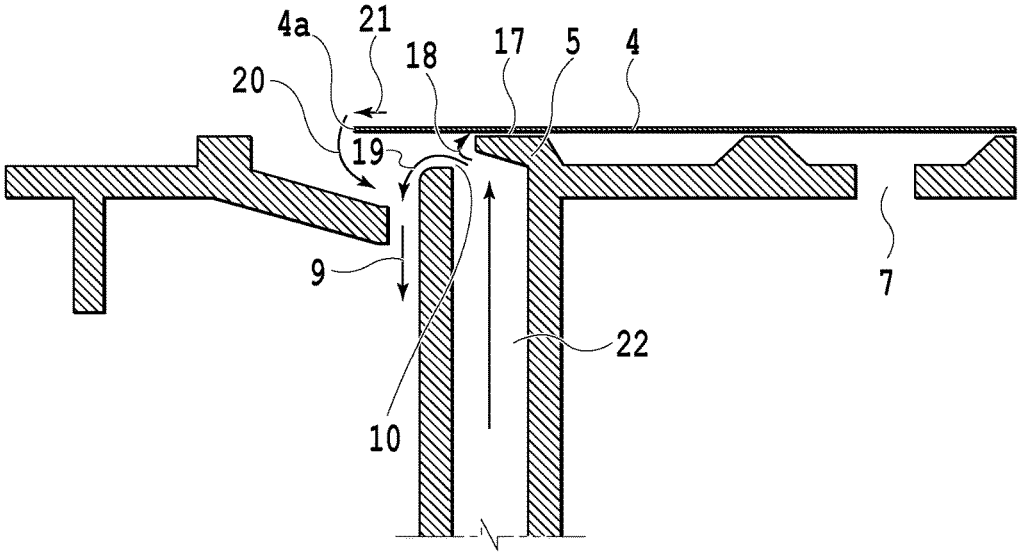
FIGS. 9A and 9B are explanatory cross-sectional views showing the flow of air in the platen shown in FIG. 8A.
Figure 9B:
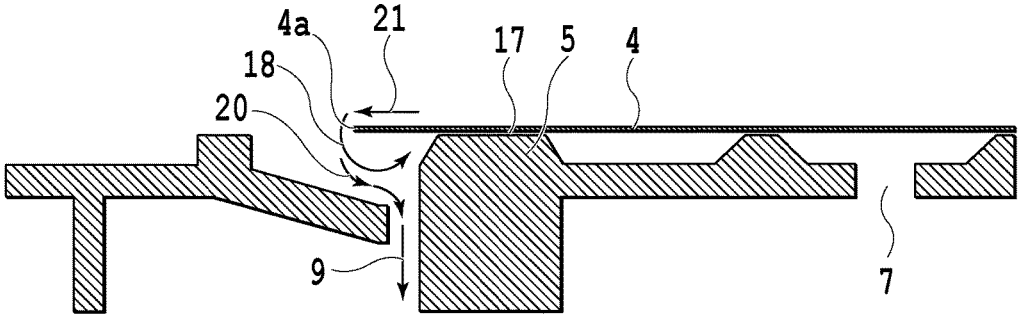

FIG. 7 is a plan view showing a platen 5 in a second embodiment; FIGS. 8A and 8B are perspective views showing the platen shown in FIG. 7, as partly viewed from slantwise above; and FIGS. 9A and 9B are explanatory cross-sectional views showing the flow of air in the platen shown in FIG. 8A, wherein FIG. 9A is a cross-sectional view taken along a line IXA-IXA' of FIG. 8A and FIG. 9B is a cross-sectional view taken along a line IXB-IXB' of FIG. 8A.

A planar portion 5A of the platen 5 has a plurality of supporting portions 6 formed in an X direction, as shown in FIG. 7, so as to support sheets 4 having various widths. Each of the supporting portions 6 includes a supporting surface 6*a* and a recess portion 6*b* surrounded by the supporting surface 6*a*. A suction hole 9 communicating with a negative pressure generator is formed at the recess portion 6*b* of the supporting portion 6. The sheet 4 supported at the supporting surface 6*a* is sucked to and held at the supporting surface 6*a* by a negative pressure generated at the suction hole 9.

Furthermore, in order to perform marginless printing on the sheets 4 having different widths, a recessed ink receiving portion 8 for receiving ink discarded outside of a side end 4*a* is formed at a position corresponding to the side end 4*a* of each of the sheets 4 at the planar portion 5A of the platen 5. The suction hole 9 communicating with the negative pressure generator is formed at the ink receiving portion 8 so as to suck and recover ink mist generated during the marginless printing through the suction hole 9.

At the planar portion 5A of the platen 5, a blowing-out hole 10, through which air that hardly contains ink mist is blown out toward the back of the sheet 4, is formed under the side end 4*a* of the sheet 4 supported at the supporting portion 6*a*. The blowing-out hole 10 communicates with an air introducing path 22 disposed inside of the platen 5. Moreover, the air introducing path 22 communicates with an air supply source 13 including a pump for actively feeding air. In the first embodiment described already, the air is passively blown out of the blowing-out hole 10 under the negative pressure in a suction/holding area 54. In contrast, the present embodiment is configured such that the air supply source 13 actively blows the air out.

The suction hole 9 and the blowing-out hole 10 that are formed at the ink receiving portion 8 are formed in such a manner as to be positioned inside of the side end 4*a* of the sheet 4 in the X direction (i.e., at the center of the sheet) so as to prevent an ink droplet from being landed on the suction hole 9 or the blowing-out hole 10 and being adhesively fixed to the suction hole 9 or the blowing-out hole 10. Moreover, the blowing-out hole 10 is formed inward of the ink recovering hole 9 (the suction hole 9) such that the air blown out of the blowing-out hole 10 flows into the ink recovering hole 9.

As shown in FIG. 9A, fresh air is blown around the end of the sheet 4 from the air supply source 13 through the blowing-out hole 10 during printing. As a consequence, the side end 4*a* of the sheet 4 is slightly warped. Even in a case where a clearance 17 is defined between the periphery of the side end 4*a* of the sheet 4 and the platen 5, the fresh air is supplied to the clearance 17 along a flow 18 of the air. At this time, the remaining air blown out of the blowing-out hole 10 forms another flow 19 of air from the blowing-out hole 10 to the ink recovering hole 9. This flow 19 of the air functions as an air curtain, and thus, inhibits air 20 that contains a large amount of ink mist and that intrudes into the sheet 4 from the outside from flowing toward the reverse of the end of the sheet 4 or the clearance 17, as shown in FIG. 9B. In this manner, it is possible to alleviate the adhesion of the ink mist onto the reverse of the sheet 4 during marginless printing.

Figure 10:
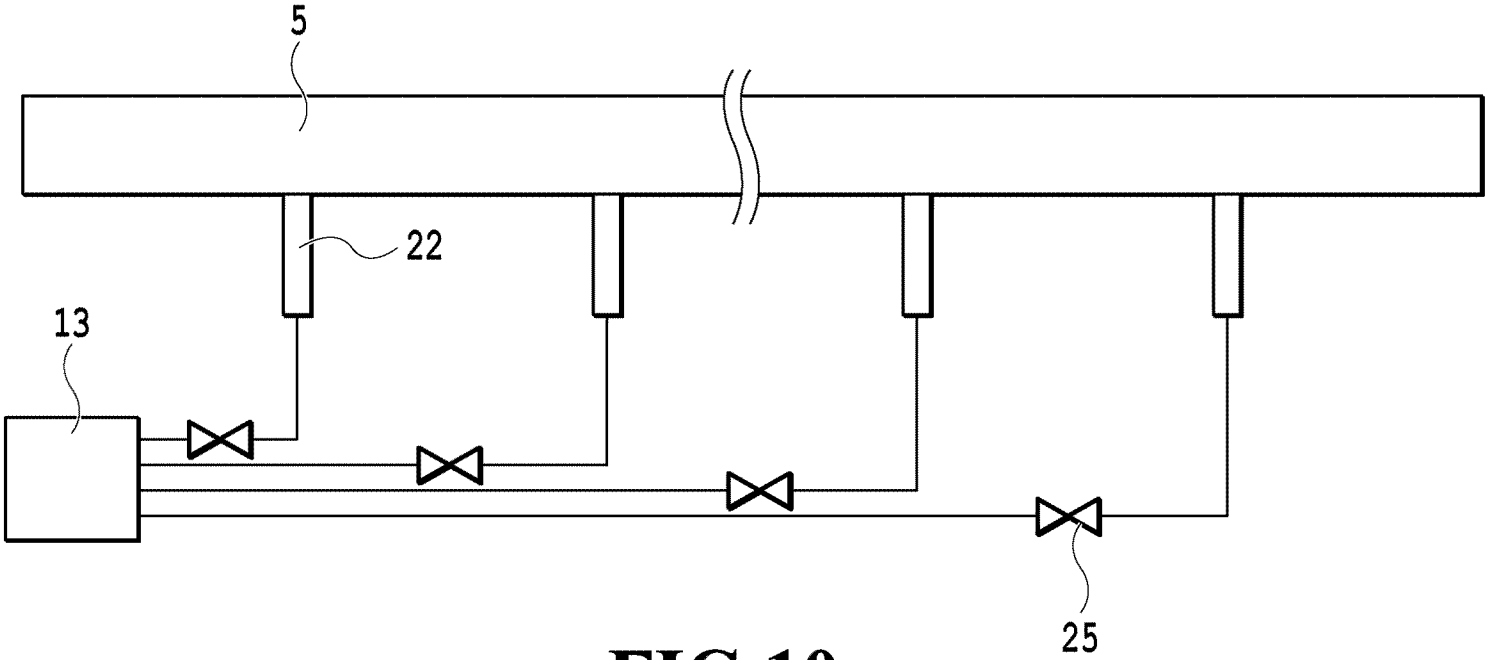
FIG. 10 is a schematic view showing an air supply mechanism in the second embodiment.

Unlike the configuration disclosed in Japanese Patent Laid-Open No. 2007-331255, the blowing-out hole 10 and the air supply source 13 communicate with each other via the air introducing path 22 disposed inside of the platen 5, as shown in FIG. 10, in the present embodiment. In addition, a valve 25 serving as a first switch interposed between the air introducing path 12 and the air supply source 13 is configured to stop the air from being blown out of portions other than the blowing-out hole 10 positioned under the side end 4*a* of the sheet 4 in a case where the sheet 4 is sucked and held. With this configuration, it is possible to reduce the smear of the ink at the end of each of the sheets 4 having different widths while properly sucking and holding the sheet 4.

Moreover, the air is actively supplied from the outside to the ink receiving portion 8 in a case where the ink receiving portion 8 is covered with the sheet 4, and then, an image is formed at the leading end of the sheet 4, thus preventing an increase in pressure at the ink receiving portion 8. Thus, it is possible to suppress the creation of the clearance defined between the sheet 4 and the leading end caused by the floating of the leading end of the sheet 4 so as to suppress the adhesion of the ink mist onto the leading end of the sheet 4.

Additionally, the flow 19 of the air is generated from the blowing-out hole 10 toward the ink recovering hole 9, as shown in FIG. 9A, thus weakening the flow of the air 20 from the side end 4*a* of the sheet 4 toward the ink recovering hole 9, so that the suction by the ink recovering hole 9 suppresses an increase in flow rate at the side end 4*a* of the sheet 4. Consequently, it is possible to alleviate the degradation of an image at the side end 4*a* of the sheet 4 during the marginless printing.

Third Embodiment

Figure 11:
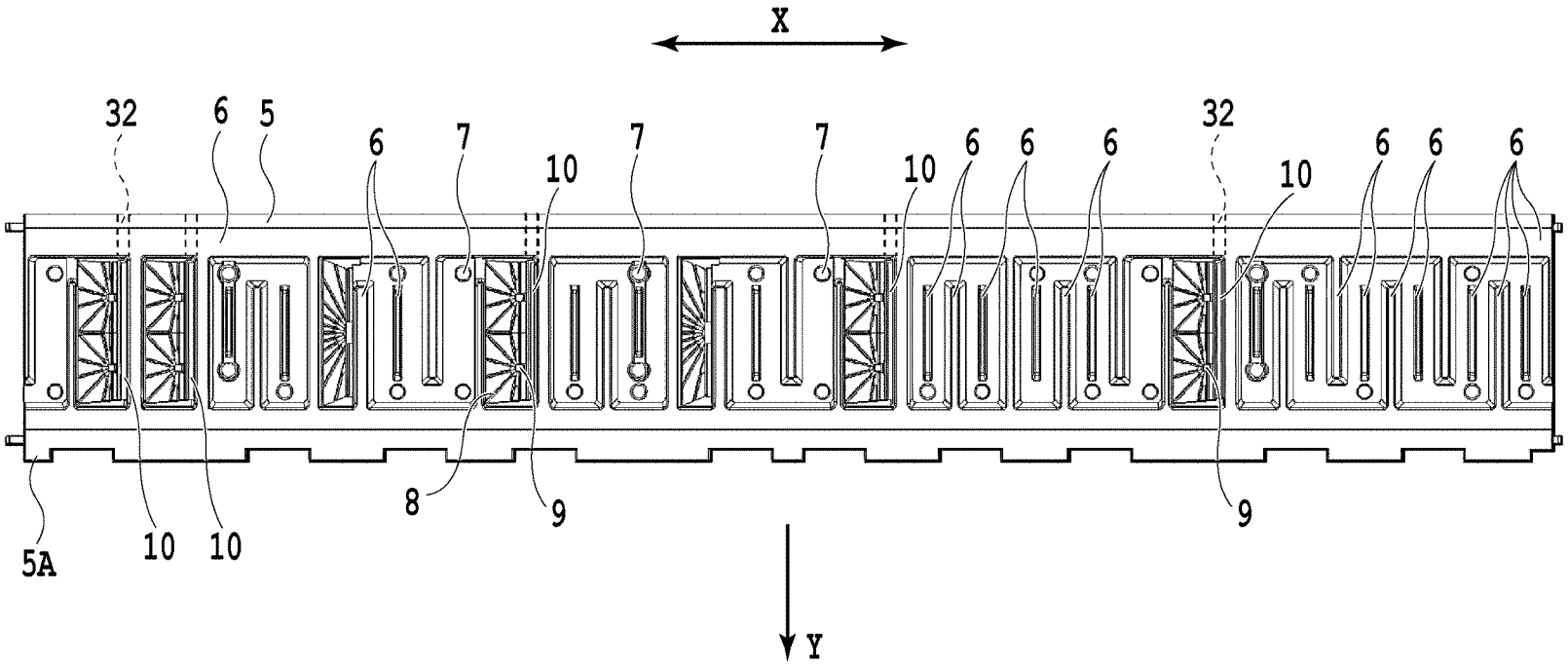
FIG. 11 is a plan view showing a platen in a third embodiment.
Figure 12A:
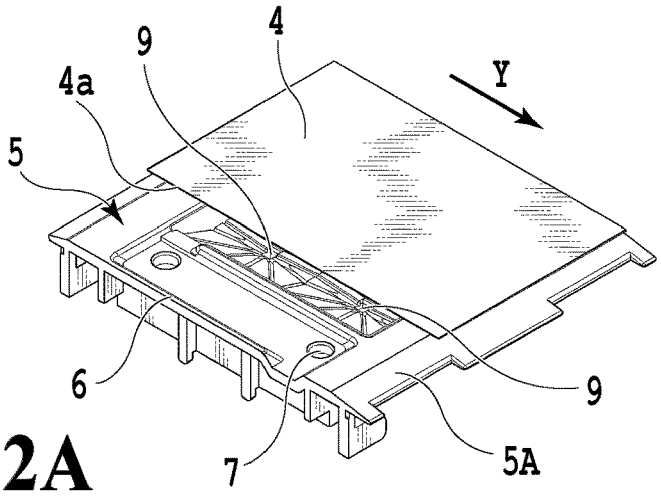
FIG. 12A is a perspective view showing a state in which a sheet is moved on the platen in the third embodiment.
Figure 12B:
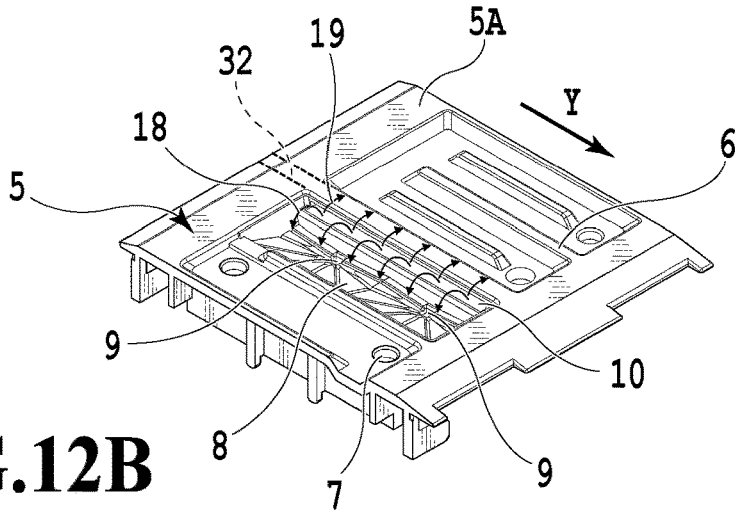
FIG. 12B is a perspective view showing the platen and the flow of air in the third embodiment.
Figure 12C:
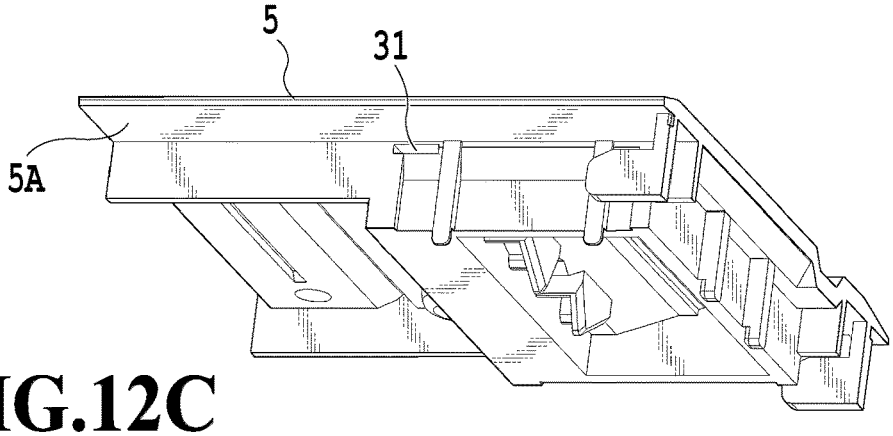
FIG. 12C is a perspective view showing the bottom side of the platen shown in FIG. 12B.

FIG. 11 is a plan view showing a platen in a third embodiment; FIG. 12A is a perspective view showing a condition in which a sheet is moved on the platen in the third embodiment; FIG. 12B is a perspective view showing the platen and the flow of air in the third embodiment; and FIG. 12C is a perspective view showing the bottom in FIG. 12B. As shown in FIGS. 11 and 12B, air introducing paths 32 extend upstream in a conveyance direction of a sheet 4 (i.e., a Y direction) inside of a platen 5. Moreover, each of the air introducing paths 32 communicates with an air introducing hole 31 (FIG. 12C) formed upstream of a planar portion 5A of the platen 5 and a blowing-out hole 10 formed at the planar portion 5A of the platen 5. The formation position and shape of the blowing-out hole 10 are the same as those in the first embodiment.

In the present embodiment, air passively flows to the blowing-out hole 10 from the air introducing hole 31 through the air introducing path 32 by a negative pressure generated in a negative pressure generation area, so that the air is blown out of the blowing-out hole 10 to the reverse of the sheet 4, like in the first embodiment. Moreover, the air introducing hole 31 is apart from the side end 4*a* of the sheet 4, and therefore, the air blown out of the blowing-out hole 10 hardly contains ink mist generated during marginless printing.

In this manner, fresh air introduced through the air introducing hole 31 formed upstream in the sheet conveyance direction is blown out of the blowing-out hole to the reverse of the sheet 4, thus suppressing the adhesion of the ink mist onto the side end 4*a* of the sheet 4 during the marginless printing.

Furthermore, ink recovering holes 9 are formed at an ink receiving portion 8 in the platen 5 upstream and downstream in the conveyance direction, respectively. As a consequence, even in a case where the leading end of the sheet 4 is conveyed up to a print start position and the air is blown out to the ink receiving portion 8 while the air introducing hole 31 is covered with the sheet 4, the two ink recovering holes 9 suck the air, so as to suppress an increase in pressure downstream at the ink receiving portion 8. In this manner, it is possible to suppress the floating of the leading end of the sheet 4 positioned downstream in the conveyance direction.

Figure 13:
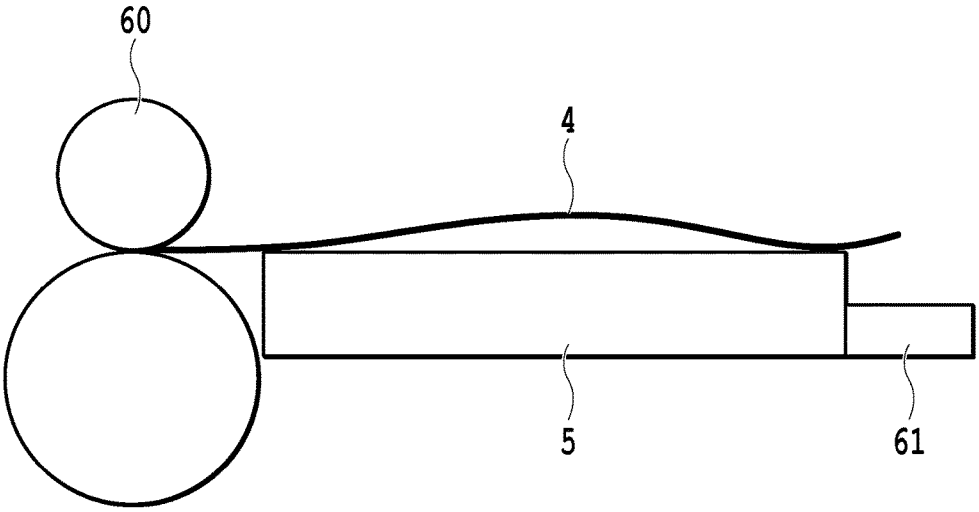
FIG. 13 is a side view schematically showing the platen and a conveyance roller pair.

Additionally, a conveyance roller pair 60 for conveying the sheet 4 is disposed upstream in the conveyance direction of the sheet 4, as shown in FIG. 13. Therefore, since a portion of the sheet 4 positioned upstream is pinched by the conveyance roller pair 60, the portion is hardly warped. Consequently, as described already, the suppression of the warp of the leading end of the sheet 4 can suppress the warp of the entire sheet. Thus, it is possible to suppress the smear of the ink mist on the reverse of the entire end of the sheet.

Fourth Embodiment

Figure 14A:
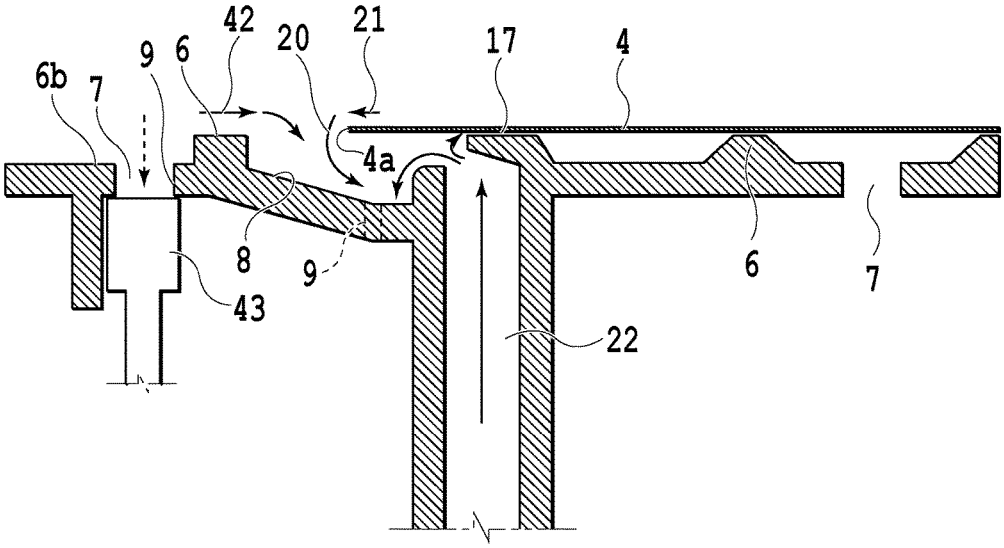
FIGS. 14A and 14B are explanatory cross-sectional views showing a fourth embodiment.
Figure 14B:
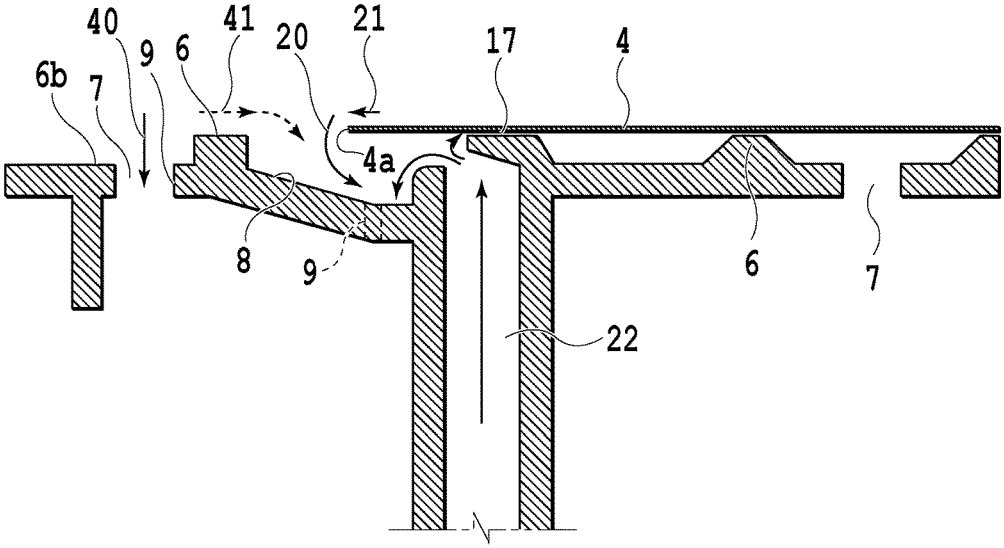

FIGS. 14A and 14B are explanatory cross-sectional views showing a fourth embodiment of the present invention. As shown in FIG. 14A, the present embodiment is featured in that in a case where a sheet 4 having a predetermined size is sucked to and held at a supporting portion 6 of a platen 5, the suction of air is stopped at another supporting portion 6 that does not support the sheet 4. In order to stop the suction of the air, there is provided a valve (i.e., a second switch) 43 for opening or closing a suction hole 9 at the lower portion of a recess portion 6*b* at the supporting portion 6. In a case where the supporting portion 6 does not support the sheet 4, the valve 43 disposed in a manner corresponding to the supporting portion 6 is moved upward, to close the suction hole 9 formed at the recess portion 6*b*, thereby stopping the suction of the air.

As shown in FIG. 14B, in a case where air 40 is sucked at the supporting portion 6 that does not support the sheet 4, the supply of air 41 to an ink receiving portion 8 from the outside of the supporting portion 6 is decreased. In contrast, the suction of the air is stopped at the supporting portion 6 in the present embodiment, as shown in FIG. 14A, and therefore, more air 42 is supplied to the ink receiving portion 8 from the outside. As a consequence, a flow 21 from a side end 4*a* of the sheet 4 to the ink recovering hole 9 is more weakened in comparison with the above-described embodiments, thereby suppressing an increase in flow rate of the air at the side end 4*a* of the sheet 4. In this manner, it is possible to alleviate the shift of the landing position of an ink droplet caused by the flow of the air during the marginless printing, so as to suppress the degradation of an image at the side end 4*a* of the sheet 4.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-187328 filed Sep. 24, 2015, which is hereby incorporated by reference wherein herein in its entirety.

What is claimed is:

1. A printing apparatus comprising:

a print head configured to print by ejecting ink on a sheet;

a platen configured to support and suction the sheet by negative pressure generated by a negative pressure generation unit, the platen being disposed at a position opposed to the print head;

an ink receiving portion configured to receive the ink ejected from the print head, the ink receiving portion being provided at a position corresponding to an end portion of the sheet in a sheet width direction; and a blowing-out hole configured to blow air from inside of the sheet toward an outside of the sheet in the sheet width direction, the blowing-out hole being provided at the ink receiving portion, wherein the blowing-out hole has a slit shape that is longer than an ejection port array of the print head in a sheet conveyance direction.

2. The printing apparatus according to claim 1, wherein the blowing-out hole blows out the air when a negative pressure state is generated in the ink receiving portion by driving the negative pressure generating unit.

3. The printing apparatus according to claim 1, further comprising:

an air supply source configured to supply air to the blowing-out hole.

4. The printing apparatus according to claim 1, further comprising a suction hole disposed at the ink receiving portion and configured to suction the ink ejected to the ink receiving portion, the suction hole communicating with a negative pressure unit.

5. The printing apparatus according to claim 1, further comprising an air introducing hole provided at a side of the platen opposed to the sheet, wherein the blowing-out hole communicates with the air introducing hole.

6. The printing apparatus according to claim 5, wherein, in a case where an end portion of the sheet is positioned above the ink receiving portion and the sheet does not cover the air introducing hole, the air taken through the air introducing hole flows through an air introducing path and blows up through the blowing-out hole toward a reverse side of the end portion of the sheet.

7. The printing apparatus according to claim 5, wherein the air introducing hole is formed at a position lower than a supporting surface of a supporting portion, at which the sheet is supported.

8. The printing apparatus according to claim 5, wherein the air introducing hole is surrounded by a rib.

* * * * *